United States Patent [19]

Holtje

[11] Patent Number: 4,569,514

[45] Date of Patent: Feb. 11, 1986

[54] COPY SHEET DECELERATOR FOR ELECTROPHOTOGRAPHIC COPIER

[75] Inventor: Bruce E. Holtje, Castle Creek, N.Y.

[73] Assignee: Savin Corporation, Stamford, Conn.

[21] Appl. No.: 628,388

[22] Filed: Jul. 6, 1984

[51] Int. Cl.[4] ..... B65H 29/20; B65H 27/00

[52] U.S. Cl. ..... 271/314; 198/624; 271/182; 271/270; 414/90

[58] Field of Search ..... 271/116, 272, 274, 314, 271/202, 203, 182, 270, 69; 198/781, 789, 790, 628, 624; 414/90

[56] References Cited

U.S. PATENT DOCUMENTS

| | | | |
|---|---|---|---|
| 3,942,786 | 3/1976 | Lauren | 271/177 |
| 4,040,617 | 8/1977 | Walkington | 271/177 |
| 4,073,223 | 2/1978 | Crawford | 271/69 |
| 4,468,021 | 8/1984 | Weber | 270/60 |

*Primary Examiner*—Douglas C. Butler
*Assistant Examiner*—John A. Carroll
*Attorney, Agent, or Firm*—Shenier & O'Connor

[57] ABSTRACT

A braking mechanism for decelerating copy sheets being delivered to a stacking tray of an electrophotographic copier includes pairs of opposing feed rollers disposed at closely adjacent longitudinally spaced locations along the sheet path to the tray. The first pair of rollers are driven at a peripheral velocity equal to that of the upstream portions of the sheet transport assembly, while the second pair of rollers are driven through an overrunning clutch at a peripheral velocity equal to about one-third to one-half the velocity of the first pair of rollers. A copy sheet entering the nip of the second pair of rollers from the first pair of rollers acts as a rigid member to drive the second pair of rollers at the upstream velocity, overrunning the clutch. When the sheet emerges from the upstream nip, frictional drag slows the second pair of rollers down to the slower velocity of their drive source, causing the sheet to be delivered to the copy tray at a relatively low rate of speed to ensure even stacking.

9 Claims, 4 Drawing Figures

COPY SHEET DECELERATOR FOR ELECTROPHOTOGRAPHIC COPIER

FIELD OF THE INVENTION

My invention relates to apparatus for decelerating sheets from a first stream velocity to a second stream velocity and, in particular, to such apparatus for decelerating copy sheets in preparation for their delivery to a stacking tray.

BACKGROUND OF THE INVENTION

Electrophotographic copiers of the image-transfer type, or plain-paper copiers as they are generally called, are well known in the art. In copiers of this type, an electrostatic latent image is first formed on a photoconductor by uniformly charging the photoconductor and then exposing the photoconductor to a light image of an original document to discharge portions of the photoconductor in a pattern corresponding to the graphic matter on the original. The photoconductor bearing the latent image is then subjected to the action of a developer, or toner, to form a developed toner image. The toner image is then transferred to a carrier sheet such as paper. Generally, in electrophotographic copiers employing the process described above, the photoconductor comprises an endless member, usually in the form of a drum, that is continuously moved at a predetermined velocity throughout the entire copy cycle. To transfer the developed toner image from the photoconductor to the carrier sheet, the sheet is brought into close proximity or actual contact with the photoconductor, while moving at the same velocity, in a transfer station.

The velocity of the photoconductor, and of the carrier sheet during image transfer, is the product of the spacing between the leading edges of successive images on the photoconductor, which must be at least the length of a copy sheet, and the copy rate. For example, for a copy rate of 60 copies per minute and a spacing of 16 inches between successive leading edges of images the sheet velocity in the transfer station must be 16 inches per second. If the copier continues to feed the sheet at this velocity as it delivers the sheet to a stacking tray, stacking will occur in an uncontrolled manner, and the edges of the stacked sheets will generally be out of register with one another. It is known in the art, as shown in Lauren U.S. Pat. No. 3,942,786, Walkington U.S. Pat. No. 4,040,617 and Crawford U.S. Pat. No. 4,073,223, that the evenness of sheet stacking may be improved by decelerating sheets before they are delivered to a stacking tray. However, the existing mechanisms for achieving this deceleration are relatively complicated mechanically, and are not readily adaptable for use with copy sheets of varying lengths or spacings.

OBJECTS OF THE INVENTION

One object of my invention is to provide a sheet decelerator that ensures even stacking of sheets in a tray.

Another object of my invention is to provide a sheet decelerator that is especially adaptable for decelerating copy sheets of an electrophotographic copier.

Still another object of my invention is to provide a sheet decelerator that is operable with closely spaced sheets.

A further object of my invention is to provide a sheet decelerator that is readily adaptable for operation with sheets of different lengths or spacings.

A still further object of my invention is to provide a sheet decelerator that does not result in jamming.

An additional object of my invention is to provide a sheet decelerator that is simple in construction.

Other and further objects will be apparent from the following description.

SUMMARY OF THE INVENTION

In general, my invention contemplates a braking mechanism for decelerating sheets such as copy sheets of an electrophotographic copier in which an upstream and a downstream pair of opposing feed rollers are disposed at closely adjacent locations longitudinally spaced along the feed path. The upstream pair of rollers are driven at the higher sheet velocity, while the downstream pair of rollers are driven at the desired lower velocity through an overrunning clutch. A sheet entering the downstream nip from the upstream pair of rollers has sufficient beam strength to act as a rigid member to drive the downstream pair of rollers at the upstream velocity, overrunning the clutch. As the sheet emerges from the upstream nip, the frictional drag slows the sheet down to the lower velocity at which the second pair of rollers are driven through the overrunning clutch, so that the sheet emerges from the downstream nip at the desired velocity.

BRIEF DESCRIPTION OF THE DRAWINGS

In the accompanying drawings, which form part of the instant specification and which are to be read in conjunction therewith, and in which like-reference numerals are used to indicate like parts in the various views.

DESCRIPTION OF THE PREFERRED EMBODIMENT

Figure 1:
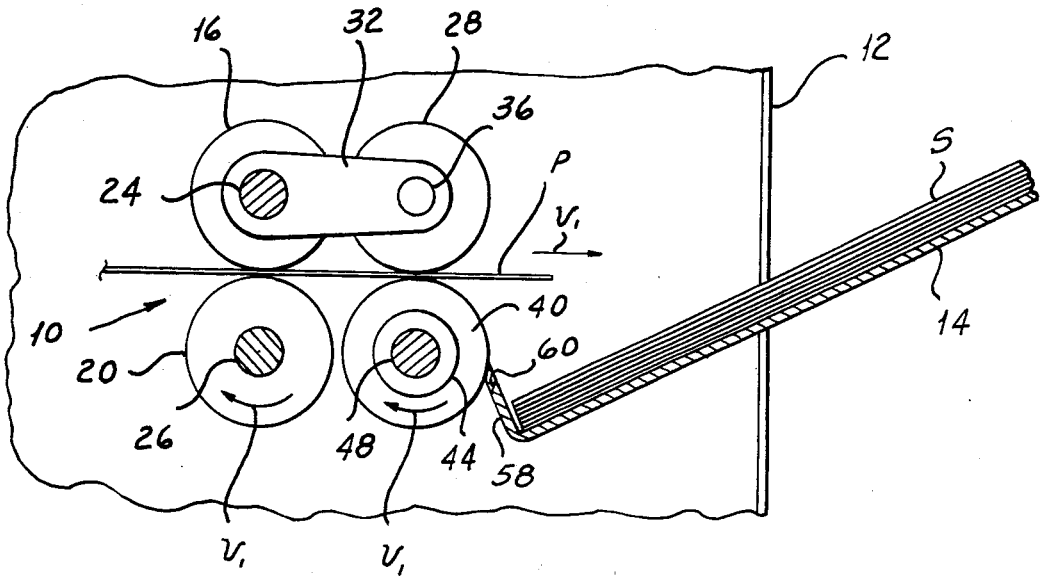
FIG. 1 is a fragmentary section of the copy exit portion of an electrophotographic copier incorporating my sheet decelerator.
Figure 3:
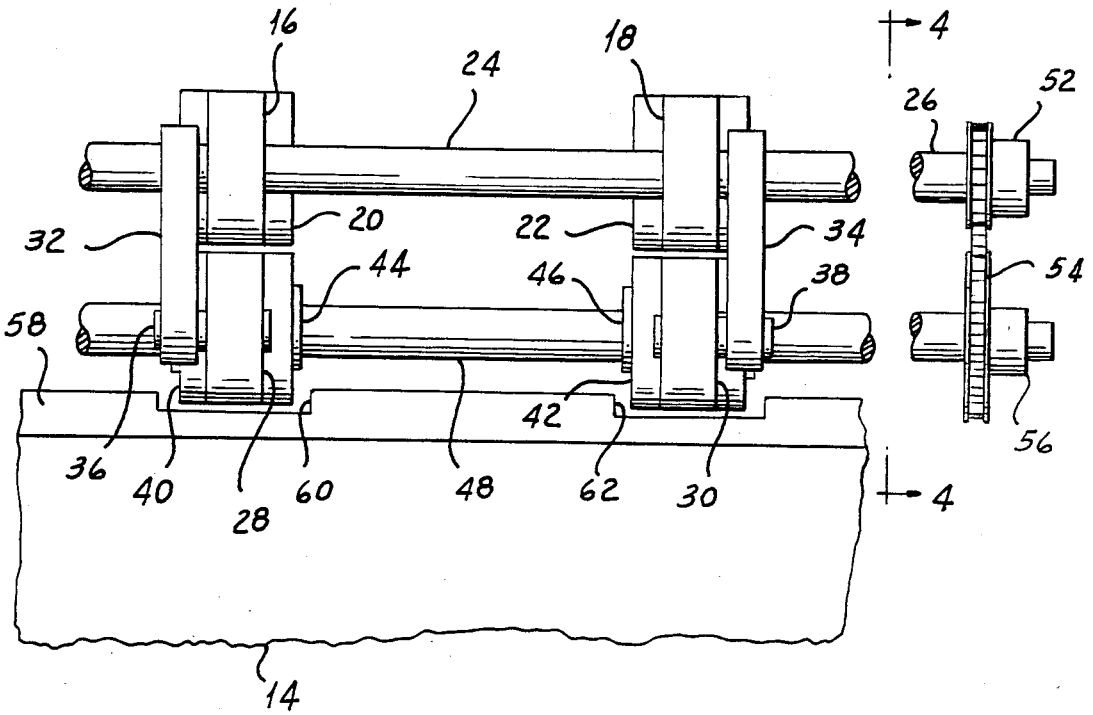
FIG. 3 is a fragmentary top plan of the exit portion shown in FIG. 1, with parts broken away.
Figure 4:
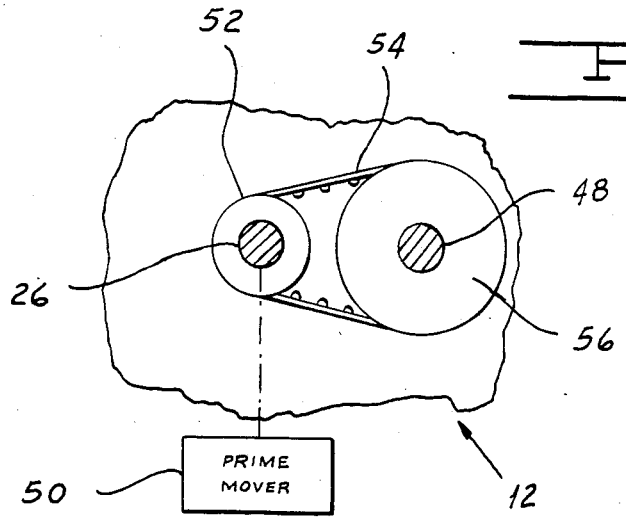
FIG. 4 is a fragmentary section of the exit portion shown in FIG. 1, along line 4—4 of FIG. 3.

Referring now to FIGS. 1 and 3, my sheet decelerator, indicated generally by the reference numeral 10, is located in the copy sheet exit portion of an electrophotographic copier indicated generally by the reference numeral 12. Sheets P of paper bearing developed electrophotographic images thereon are delivered to an inclined exit tray 14, to be described in more detail below, to form a stack S of collected sheets. The decelerator 10 includes a first pair of transversely spaced friction feed rollers 16 and 18 rotatably supported on a shaft 24 carried by the copier frame. Respective lower friction feed rollers 20 and 22 oppose upper rollers 16 and 18 to form transversely spaced sheet-engaging nips. A shaft 26 supporting lower rollers 20 and 22 for rotation therewith is likewise supported by the copier frame. Referring now to FIG. 4, a prime mover 50 of any suitable type known to the art drives lower rollers 20 and 22 at a peripheral velocity v1 equal to the velocity of the upstream portions (not shown) of the copy sheet transport of the copier 12.

Respective pivot arms 32 and 34 carried by shaft 24 rotatably support respective friction rollers 28 and 30, by way of shafts 36 and 38, at a location immediately downstream from rollers 16 and 18. Respective lower friction rollers 40 and 42 coupled to a shaft 48 by respective overrunning clutches 44 and 46 oppose rollers 28 and 30 to form a second pair of sheet-engaging nips downstream from the pair formed by rollers 16 and 18 and 20 and 22. Shaft 48, which is supported by the frame (not shown) of copier 12, is driven from shaft 26 by means of a belt 54 supported by respective pulleys 52 and 56 on shafts 26 and 48. Preferably, the diameters of pulleys 52 and 56 are such that in the absence of a sheet of paper P in the downstream nip, rollers 40 and 42 are driven at a surface velocity v2 between one-third and one-half the peripheral velocity v1 of rollers 20 and 22. An upwardly extending retaining lip 58 formed at the end of tray 14 adjacent rollers 40 and 42 is preferably formed with slots 60 to permit the lip 58 to extend inwardly beyond the peripheries of rollers 40 and 42, thereby to prevent sheets P from slipping between lip 58 and rollers 40 and 42.

Figure 2:
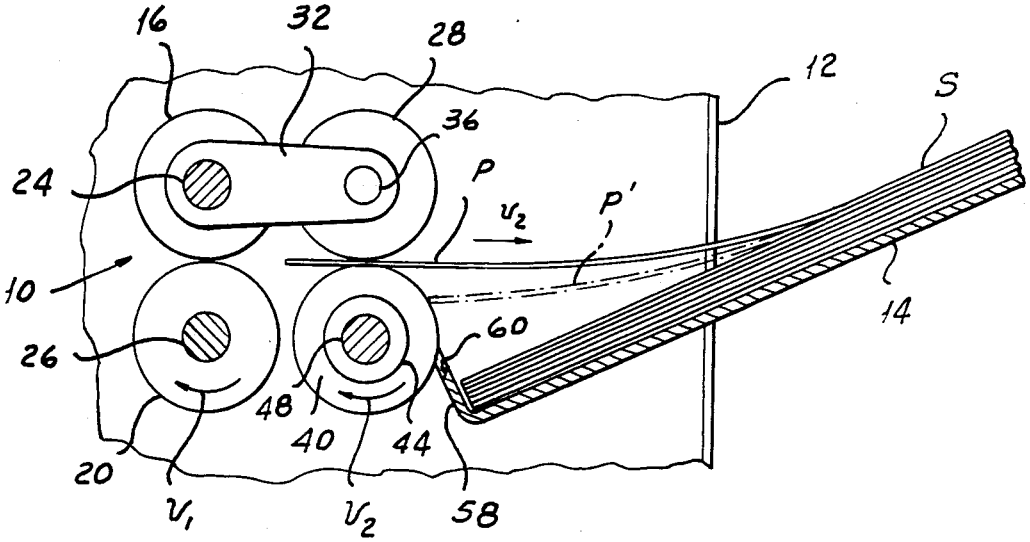
FIG. 2 is a fragmentary section of the exit portion shown in FIG. 1, at a later stage in the sheetdelivery cycle.

Whenever a sheet P is entrained in both the downstream and the upstream sets of rollers, as shown in FIG. 1, the beam stiffness of the sheet P is such as to cause rollers 40 and 42 to overdrive clutches 44 and 46, so that all the rollers rotate at the peripheral velocity v1. Clutches 44 and 46 are so selected as to have an overrunning drag force, referred to the roller nip, less than the force required to buckle the sheet P. However, when the sheet P emerges from the nip formed by the upstream set of rollers 16, 18, 20 and 22, as shown in FIG. 2, clutches 44 and 46 lose their overdriving torque, and rapidly decelerate rollers 40 and 42, by virtue of their frictional drag, to the reduced velocity v2 provided by shaft 48. As a result, the sheet P is braked to the velocity v2 before the sheet is discharged from the nip formed by the downstream set of rollers 28, 30, 40 and 42. Accordingly, the sheet P joins the set S on the tray 14 in a controlled manner. The control of the delivery of the sheet to the stack S is further enhanced by the fact that, following the emergence of the trailing edge of the sheet P from rollers 28, 30, 40 and 42, the lower rollers 40 and 42 continue to guide the trailing edge of the sheet as it descends to the level of the stack S, in the manner shown in phantom lines in FIG. 2.

Each of the upper rollers 28 and 30 is urged against the corresponding lower roller 40 or 42 by its own weight and that of its associated support assembly. If desired, this resilient biasing force may be either increased or decreased by the use of springs (not shown). The total normal nip force exerted by upper rollers 28 and 30 against the sheet P should be sufficiently high to prevent slippage between the sheet and any of the downstream rollers. At the same time, the nip force should not be so high as to prevent the sheet P from freely entering the downstream nip. By resiliently biasing upper rollers 28 and 30 against lower rollers 40 and 42 in the manner described, I ensure against variations in normal nip force due to roller runout and the like.

It will be apparent from the foregoing description that downstream rollers 28, 30, 40 and 42 only move sheet P at the slower speed v2 during the relatively short time interval that the trailing sheet edge is between the upstream and downstream nips. Thus, the speed reduction ratio vl/v2 can be relatively high, even if successive sheets P entering the upstream nip are relatively closely spaced, without causing sheet pileup in the downstream nip. In general, for a spacing s between the upstream and downstream nips, the minimum sheet spacing d is given by the formula.

$$d=s(v1/v2-1). \quad (1)$$

Stated somewhat differently, for a given spacing d between sheets, the maximum allowable speed reduction ratio is given by the formula $$v1/2=d/s+1. \quad (2)$$

Accordingly, for optimum operation, the downstream rollers 28, 30, 40 and 42 should be as close as possible to the corresponding upstream rollers 16, 18, 20 and 22 without actually touching. Placing the downstream rollers close to the upstream rollers in this manner also ensures that the sheet P acts as a rigid beam and does not buckle when it overdrives clutches 44 and 46.

It will be seen that I have accomplished the objects of my invention. My sheet decelerator ensures even stacking of sheets in a tray, and is especially adaptable for use in a high-speed electrophotographic copier. My sheet declerator is operable with closely spaced sheets, and is readily adaptable for operation with sheets of different lengths or spacings. Finally, my sheet decelerator is simple in construction and reliable.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for feeding sheets in a predetermined direction along a path including in combination first sheet gripping means disposed along said path, second sheet gripping means spaced in said direction from said first gripping means, first driving means for driving said first gripping means at a predetermined speed to move said sheet in said direction along said path, and second driving means responsive to the movement of the trailing edge of said sheet past a predetermined location along said path for driving said second gripping means at a reduced speed to move said sheet in said direction along said path.

2. Apparatus as in claim 1 in which said second driving means includes a driven member and means responsive to the movement of said edge past said location for coupling said second gripping means to said member.

3. Apparatus as in claim 1 in which said second driving means drives said second gripping means at said reduced speed in response to the release of said sheet by said first gripping means.

4. Apparatus as in claim 1 in which said second driving means includes a driven member and means responsive to the release of said sheet by said first gripping means for coupling said second gripping means to said member.

5. Apparatus for feeding sheets in a predetermined direction along a path including in combination first sheet gripping means disposed along said path, second sheet gripping means spaced in said direction from said first gripping means, first driving means for driving said first gripping means at a predetermined speed to move said sheet in said direction along said path, second driving means for driving said second gripping means at a reduced speed to move said sheet in said direction along said path, and means including an overrunning clutch for coupling said second driving means to said second gripping means.

6. Apparatus as in claim 5 in which said second gripping means includes a pair of nip-forming feed members.

7. Apparatus as in claim 5 in which said second gripping means includes a pair of nip-forming feed members and means for biasing one of said members toward the other of said members.

8. Apparatus for feeding sheets in a predetermined direction along a path including in combination a first pair of opposing feed members disposed along said path, a second pair of opposing feed members spaced in said direction from said first pair of feed members, said second pair of feed members being closely adjacent to said first pair of feed members, means for driving one of said first pair of feed members at a predetermined speed to move said sheet in said direction along said path, and means for driving one of said second pair of feed members at a reduced speed to move said sheet in said direction along said path.

9. Apparatus as in claim 8 in which said feed members comprise rollers.

* * * * *